US009362657B1

(12) United States Patent
Yang

(10) Patent No.: US 9,362,657 B1
(45) Date of Patent: Jun. 7, 2016

(54) QUICK MOUNT CONNECTOR ASSEMBLY OF ARTIFICIAL CHRISTMAS TREE

(71) Applicant: JETMAX LIGHTING INDUSTRIAL CO., LIMITED, Dougguan, Guangdong (CN)

(72) Inventor: Ping Yang, Guangdong (CN)

(73) Assignee: JETMAX LIGHTING INDUSTRIAL CO., LIMITED, Dongguan, Guangdong (CN)

( * ) Notice: Subject to any disclaimer, the term of this patent is extended or adjusted under 35 U.S.C. 154(b) by 0 days.

(21) Appl. No.: 14/622,049

(22) Filed: Feb. 13, 2015

(51) Int. Cl.
*H01R 25/00* (2006.01)
*H01R 13/502* (2006.01)
*H01R 4/28* (2006.01)

(52) U.S. Cl.
CPC ..... *H01R 13/502* (2013.01); *H01R 4/28* (2013.01)

(58) Field of Classification Search
CPC ..... H01R 13/502; H01R 4/28; H01R 13/17; H01R 4/38
USPC ..... 439/638
See application file for complete search history.

(56) References Cited

U.S. PATENT DOCUMENTS

| | | | | |
|---|---|---|---|---|
| 4,586,844 | A * | 5/1986 | Hammonds | E04G 7/20 182/178.3 |
| 8,132,649 | B2 * | 3/2012 | Rogers | E04G 7/20 182/178.6 |
| 8,454,187 | B2 * | 6/2013 | Chen | 362/122 |
| 8,870,404 | B1 * | 10/2014 | Chen | F21S 4/001 29/825 |
| 8,959,810 | B1 * | 2/2015 | Leung | H01R 24/38 40/442 |
| 9,044,056 | B2 * | 6/2015 | Chen | A41G 1/005 |
| 9,209,546 | B1 * | 12/2015 | Gibboney, Jr. | H01R 13/17 |

* cited by examiner

*Primary Examiner* — Jean F Duverne
(74) *Attorney, Agent, or Firm* — Birch, Stewart, Kolasch & Birch, LLP

(57) ABSTRACT

Provided is a quick mount connector assembly of an artificial Christmas tree, the connector assembly including: a male connector and a female connector. The male connector has a male shell that has a plug end, an electrical connection shaft being cylindrical and extending outward from the plug end, a through hole, and a clamping pin installed in the through hole. The female connector is detachably connected to the male connector and has a female shell detachably connected to the male shell and having an electrical connection hole receiving the electrical connection shaft for building an electrical connection, a through hole, and a clamping pin installed in the through hole of the female shell. When any one of the connectors is broken, the broken connector can be quickly dismantled and repaired because the shells are detachable. The connector assembly is suitable for both DC and AC currents.

18 Claims, 7 Drawing Sheets

QUICK MOUNT CONNECTOR ASSEMBLY OF ARTIFICIAL CHRISTMAS TREE

BACKGROUND OF THE INVENTION

1. Field of the Invention

The present invention relates to an electrical connector, and more particularly to a quick mount connector assembly of an artificial Christmas tree.

2. Description of the Related Art

As culture of Christmas celebrations spreads, Christmas tree decorated with lights become the best adornment to increase the festival atmosphere. The artificial Christmas trees commercially available on markets are generally composed by trunks, branches, wires, and colorful lights. Band connectors are utilized to avoid wiring troubles induced by long wires. A wire is inserted into the trunks from the bottom of the tree and through the trunks to the outside of the trunks. Then the wire is connected to a next wire by the band connector. The artificial Christmas tree has a male connector and a female connector, the male connector is fastened on an inner wall of a part of the tree, and the female connector is fastened on an inner wall of another part of the tree. The wires are linked between neighboring tree segments by the male connector and the female connector. It is easy and convenient to link every wire from the bottom to the top of the Christmas tree by the male connector and the female connector after all tree segments are constructed.

However, currently the male connector and the female connector are formed by solid molding, the wires are fixed by plastic in the male connector and the female connector. The structure, shape, and size are customized. When the male connector or the female connector has a short circuit or a broken circuit, the male connector or the female connector is discarded and cannot be dismantled and repaired. In addition, currently the connectors are not universally compatible and interchangeable for every kind of Christmas tree. For example, when the voltage of lights for Christmas tree is less than 36V, the connectors cannot be applied with higher voltage or will otherwise have a short circuit.

SUMMARY OF THE INVENTION

An objective of the present invention is to provide a quick mount connector assembly of an artificial Christmas tree; the connector assembly is disassemble-able with universal compatibility. In addition, the shells of the connectors of the connector assembly are insulated, and the present invention is suitable for both DC and AC currents.

To achieve the foregoing objective, the quick mount connector assembly of an artificial Christmas tree comprises:

a male connector and a female connector mutually connectable. The male connector has a male shell and the female connector has a female shell, and the male shell and the female shell are detachably connected. The male shell and the female shell each respectively has a through hole defined radially through the male shell and the female shell, and clamping pins are installed in the through holes. The Christmas tree has an inner chamber, and the male connector and the female connector are fixed in the inner chamber of the Christmas tree by the clamping pins. The male shell has a plug end and an electrical connection shaft, and the electrical connection shaft further extends outward from the plug end. The electrical connection shaft is cylindrical. The female shell has an electrical connection hole, and the electrical connection hole is corresponding to the electrical connection shaft. When the male connector and the female connector are connected with each other, the electrical connection shaft is inserted into the electrical connection hole for building an electrical connection. Particularly, the electrical connection shaft includes a hollow shaft core, a male contact core that is used to connect to an anode of a DC power supply or a live wire of a AC power supply, and a male contact shaft that is used to connect to a cathode of a DC power supply or a neutral wire of an AC power supply. The male contact core is mounted on an external surface of the shaft core securely, and the male contact shaft is inserted into a front end of the shaft core. The electrical connection hole is corresponding to the male contact core and the male contact shaft, and the female shell has a clamping base for clamping the male contact shaft. Furthermore, the female shell also has a female contact ring, and the female contact ring is mounted on the external surface of the male contact core. When the electrical connection shaft and the electrical connection hole are connected with each other, a front end of the male contact shaft is inserted into the clamping base. The female contact ring is mounted on the external surface of the male contact core.

Furthermore, the male contact core has multiple projecting ribs on the outer circumference of the male contact core and the female contact ring is a cylindrical ring. When the male contact core connects to the female contact ring, the projecting ribs are pressed against the inner wall of the cylindrical ring.

In addition, the clamping base has two pressing resilient pieces. The two pressing resilient pieces are installed on two opposite sides of the clamping base, and each of the pressing resilient pieces further includes a semi-circular notch.

Particularly, the male shell includes a male upper shell and a male lower shell, and the male upper shell and the male lower shell are engaged with each other and fastened by screws. The female shell also includes a female upper shell and a female lower shell, and the female upper shell and the female lower shell are engaged with each other and fastened by screws.

Furthermore, the male upper shell, the male lower shell, the female upper shell, and the female lower shell each respectively has two positioning protrusions and two square grooves. The square grooves are for installing the two positioning protrusions. The bottoms of positioning protrusions are inserted into the square grooves, and the tops of the positioning protrusions are arc-shaped.

Particularly, the male shell has a conical protrusion on a front end of the male shell, and the female shell has a conical recess on a front end of the female shell. The conical protrusion is corresponding to the conical recess. When the male connector and the female connector are connected with each other, the conical protrusion is inserted into the conical recess.

Particularly, the male shell and the female shell each respectively has at least one power base in the shell.

In addition, the electrical connection shaft has a spring between the shaft core and the male contact shaft.

Furthermore, the quick mount connector assembly further has a rubber ring. The male connector and the female connector each respectively has a ring groove around the male shell and the female shell, and the ring groove is covered by the rubber ring.

The present invention has advantages as follows:

The present invention provides a quick mount connector assembly of an artificial Christmas tree that includes a male connector and a female connector. The male connector has a male shell that has a plug end, an electrical connection shaft being cylindrical and extending outward from the plug end, a through hole, and a clamping pin installed in the through hole.

The female connector is detachably connected to the male connector and has a female shell detachably connected to the male shell and having an electrical connection hole receiving the electrical connection shaft for building an electrical connection, a through hole, and a clamping pin installed in the through hole of the female shell. The Christmas tree has an inner chamber, and the male connector and the female connector are mounted in the inner chamber of the Christmas tree by the clamping pins. By replacing conventional solid molding by the detachable shells, the connectors in the male shell and the female shell are not fixed by solid plastic molding. When broken, the connector can be quickly dismantled and repaired. The area of electrical contact surface is large and the present invention is suitable for both DC and AC currents. These advantages make the quick mount connector assembly universally compatible and interchangeable.

DETAILED DESCRIPTION OF THE INVENTION

Figure 1:
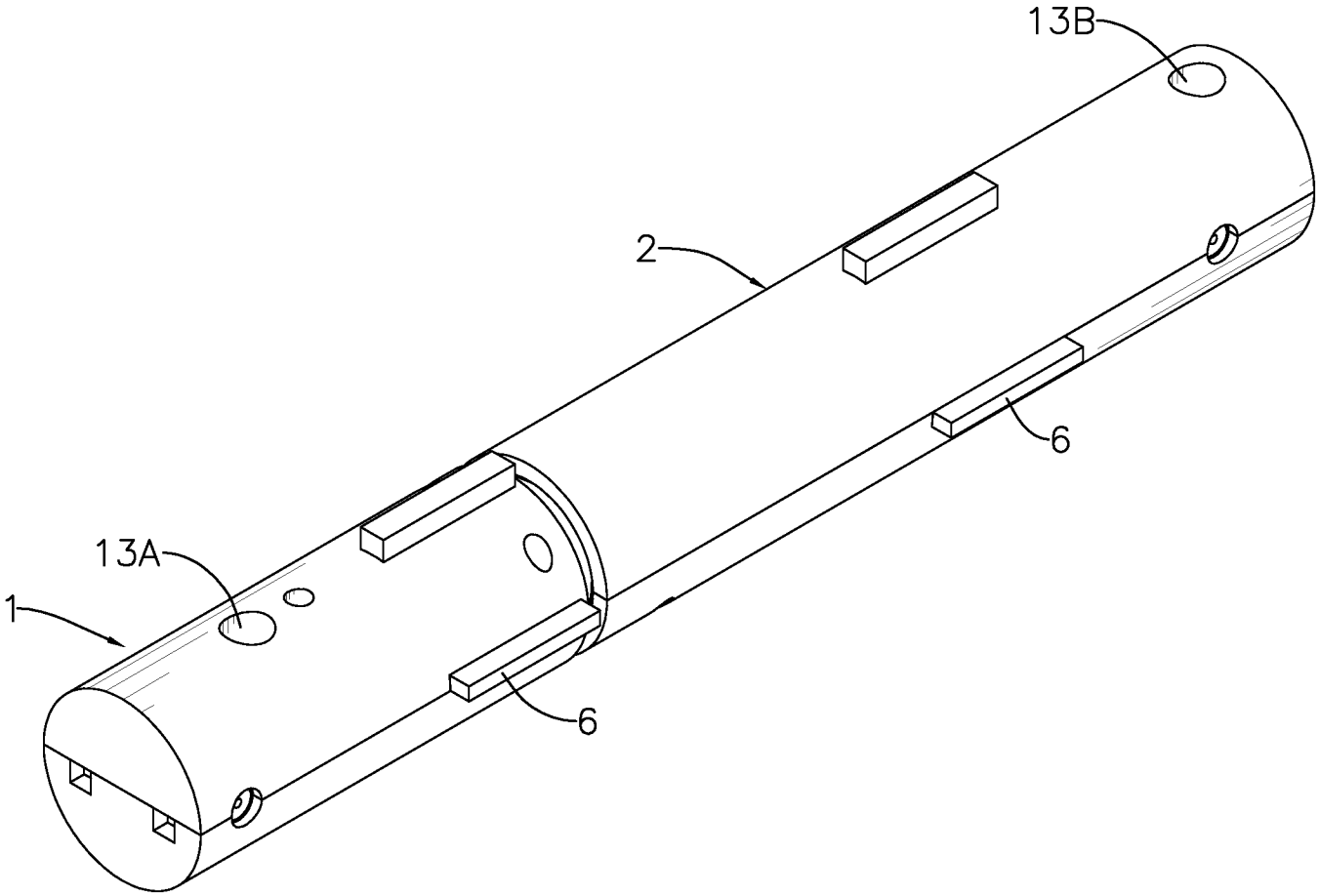
FIG. 1 is a schematic perspective view of the quick mount connector assembly of an artificial Christmas tree in accordance with the present invention.
Figure 2:
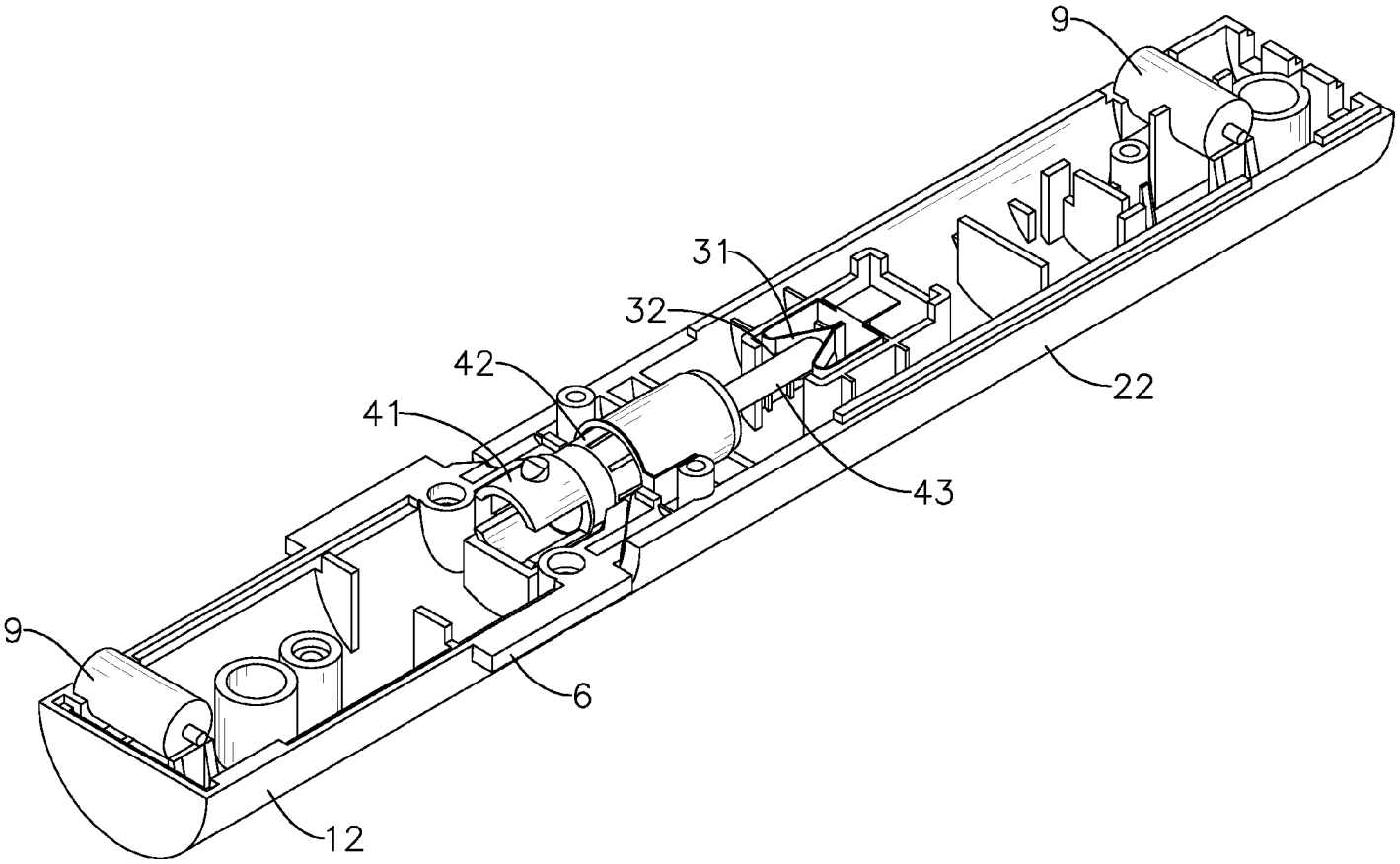
FIG. 2 is an internal view of the quick mount connector assembly in accordance with the present invention, shown assembled.
Figure 3:
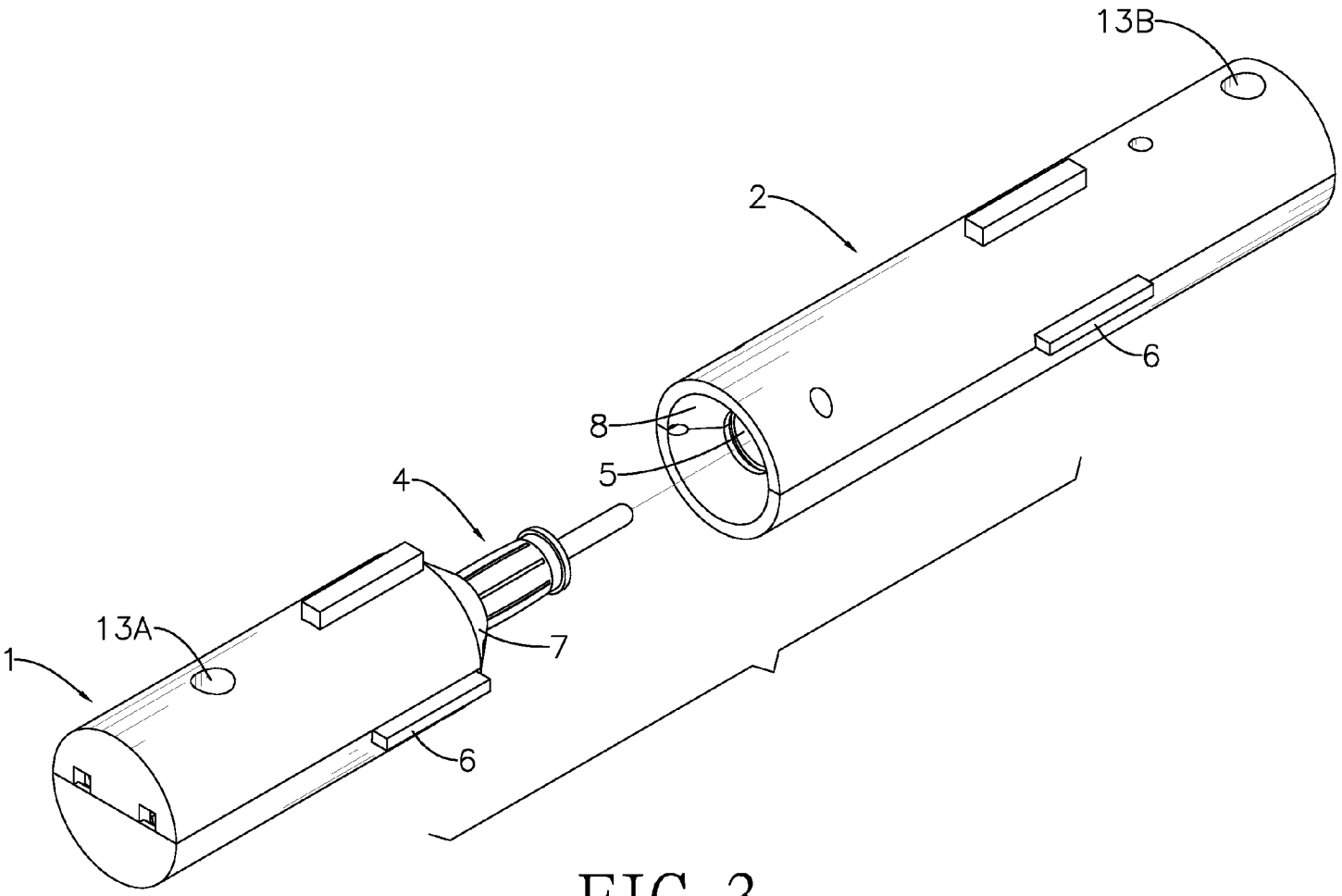
FIG. 3 is a schematic perspective view of the quick mount connector assembly in accordance with the present invention, shown disassembled.
Figure 4:
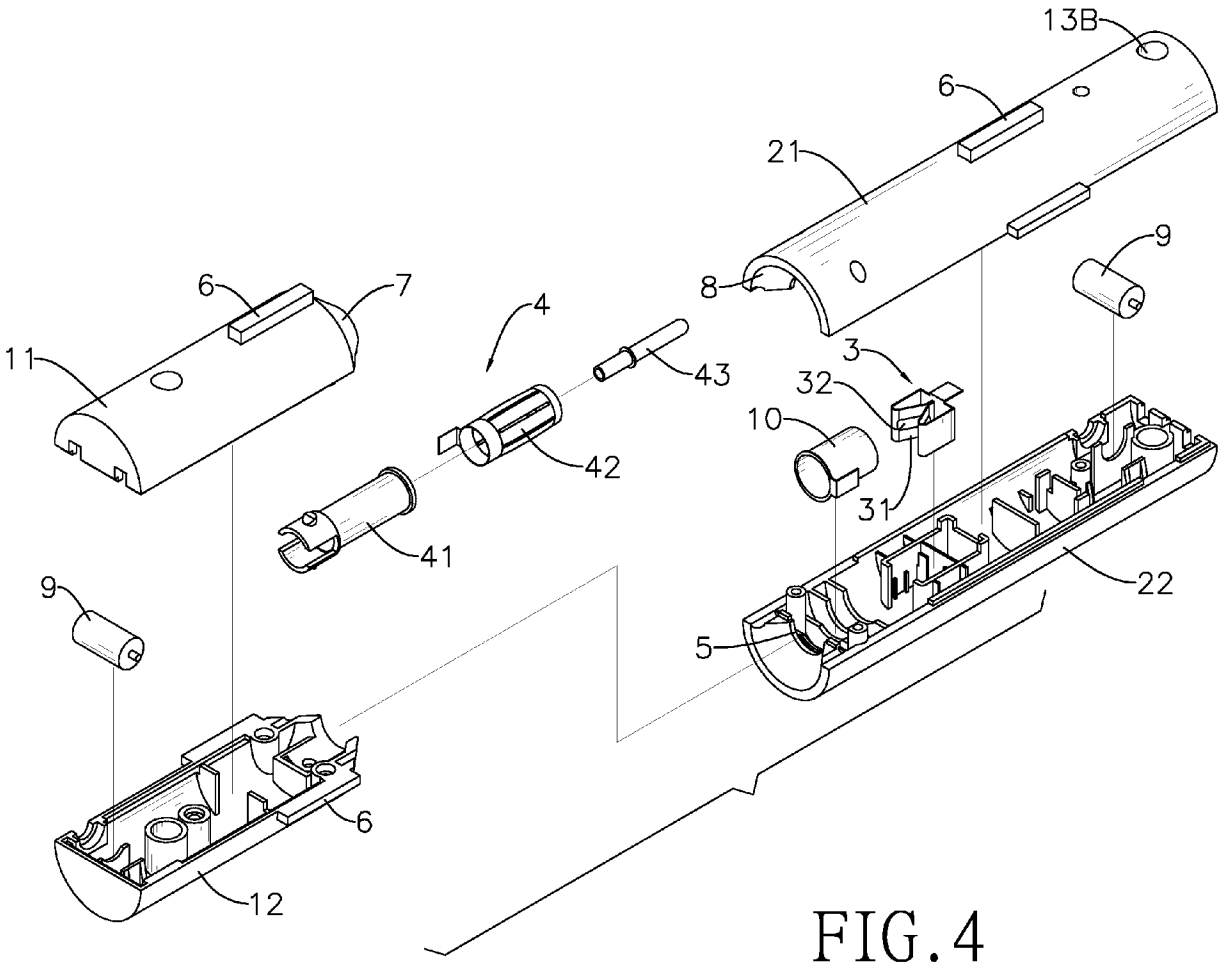
FIG. 4 is an exploded perspective view of the quick mount connector assembly in accordance with the present invention.
Figure 5:
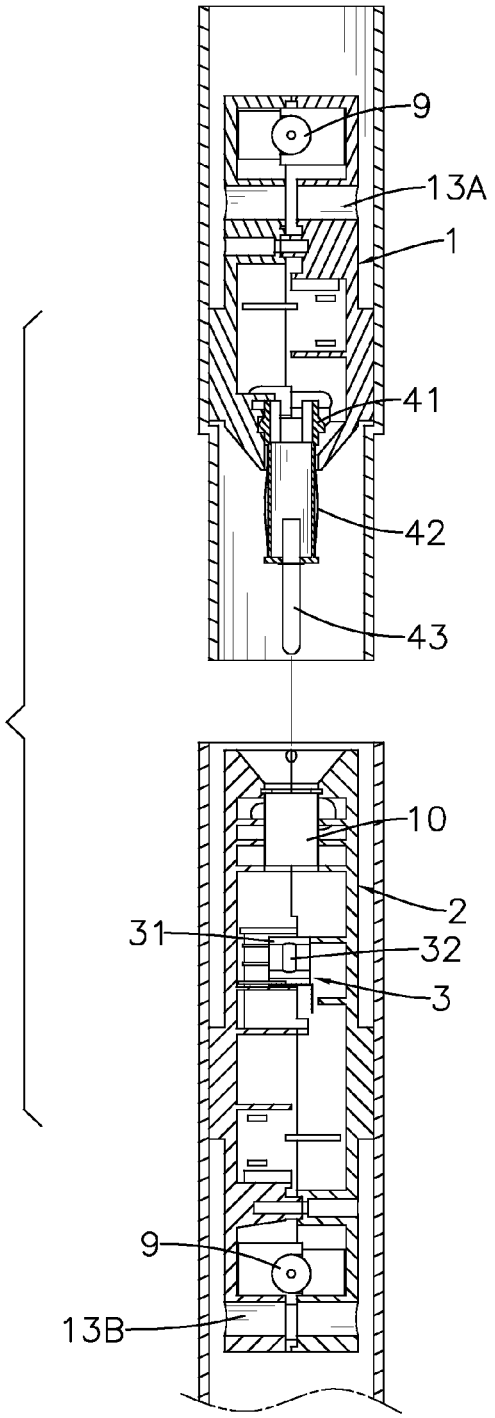
FIG. 5 is a cross-sectional side view of the quick mount connector assembly, shown installed in the tree trunk.

With reference to FIGS. 1-5, a quick mount connector assembly of an artificial Christmas tree comprises: a male connector 1 and a female connector 2. The male connector 1 has a male shell. The male shell has a plug end, an electrical connection shaft 4 being cylindrical and extending outward from the plug end, a through hole 13A defined radially through the male shell, and a clamping pin installed in the through hole 13A. The female connector 2 is detachably connected to the male connector 1. The female connector 2 has a female shell. The female shell is detachably connected to the male shell, and the female shell has an electrical connection hole 5 receiving the electrical connection shaft 4 for building an electrical connection, a through hole 13B defined radially through the female shell, and a clamping pin installed in the through hole 13B of the female shell. The artificial Christmas tree has an inner chamber, and the male connector 1 and the female connector 2 are mounted in the inner chamber of the Christmas tree by the clamping pins.

By replacing conventional solid molding with the detachable male shell and female shell, the male and female connectors in the male shell and the female shell are not assembled by solid molding. When any one of the connectors is broken, the male connector 1 and the female connector 2 can be dismantled quickly via the clamping pins for repair. Specifically, the male connector 1 and the female connector 2 are respectively set up in two trunks of a Christmas tree. Users only need to mutually connect the two trunks that are respectively installed in the male connector 1 and the female connector 2, and the electrical connection is built quickly. In one embodiment, the electrical connection shaft 4 includes a hollow shaft core 41, a male contact core 42 used to connect to an anode of a DC power supply or a live wire of an AC power supply, and a male contact shaft 43 used to connect to a cathode of a DC power supply or a neutral wire of an AC power supply. The male contact core 42 is mounted on an external surface of the shaft core 41 securely, and the male contact shaft 43 is inserted into a front end of the shaft core 41. The electrical connection hole 5 is corresponding to the male contact core 42 and the male contact shaft 43, and the female shell has a clamping base 3 for clamping the male contact shaft 43. The female shell further has a female contact ring 10, and the female contact ring 10 is selectively mounted on an external surface of the male contact core 42. When the electrical connection shaft 4 and the electrical connection hole 5 are connected with each other, the front end of the male contact shaft 43 is inserted into the clamping base 3, and the female contact ring 10 is mounted on the external surface of the male contact core 42. Because the area of electrical contact surface between the electrical connection shaft 4 and the electrical connection hole 5 is large, the connector assembly is suitable for both DC and AC currents. This advantage makes the quick mount connector universally compatible and interchangeable.

Furthermore, the male contact core 42 has multiple projecting ribs on the outer circumference of the male contact core 42. The female contact ring 10 is a cylindrical ring. When the male contact core 42 connects to the female contact ring 10, the projecting ribs are pressed against the inner wall of the cylindrical ring. The projecting ribs are formed by stamping and are deformable. In connecting process, the projecting ribs can be easily inserted into the cylindrical ring by external force. The projecting ribs and the cylindrical ring are in perfect contact.

Furthermore, the clamping base 3 has two pressing resilient pieces 31. The two pressing resilient pieces 31 are installed on two opposite sides of the clamping base 3. Each of the pressing resilient pieces 31 further includes a semi-circular notch 32 for insertion of the male contact shaft 43 into the clamping base 3. When the electrical connection shaft 4 connects to the electrical connection hole 5, the front end of the male contact shaft 43 is inserted into the clamping base 3. Particularly the front end of the male contact shaft 43 is inserted into the clamping base 3 through the semi-circular notch 32. The two pressing resilient pieces 31 are pressed against the male contact shaft 43 such that the male contact shaft 43 and the clamping base 3 are in good contact.

In the present invention, the male shell includes a male upper shell 11 and a male lower shell 12. The male upper shell 11 and the male lower shell 12 are engaged with each other and fastened by screws. The female shell also includes a female upper shell 21 and a female lower shell 22. The female upper shell 21 and the female lower shell 22 are engaged with each other and fastened by screws. The male lower shell 12 and the female lower shell 22 both have engaging members and screws. For combining the upper shell and the lower shell, the upper shell and the lower shell are first engaged with each other and then fastened by screws. In another embodiment, the upper shell and the lower shell can be fixed by high frequency welding after they are engaged with each other for high assembling efficiency.

Furthermore, the male upper shell 11, the male lower shell 12, the female upper shell 21, and the female lower shell 22 each respectively has two positioning protrusions 6 and two square grooves (not shown in figure). The square grooves are used to install the two positioning protrusions 6. The bottoms of the positioning protrusions 6 are inserted into the square grooves, and the length of the positioning protrusions 6 can be adjusted according to the size of the inner chamber of the Christmas tree. Shorter positioning protrusions 6 are selected for installation in a smaller inner chamber, and longer positioning protrusions 6 are for a bigger inner chamber. This advantage makes the connector assembly of the present invention applicable for Christmas trees of any size. The manufacturer does not need to manufacture various molds for connectors of different sizes. The tops of the positioning protrusions 6 are arc-shaped. When the positioning protrusions 6 are fixed, the arc-shaped top can contact the inner wall of the tree's trunk to increase friction between the shells and the inner wall of the tree's trunk. As such, the male connector 1 and the female connector 2 are also securely fixed in the tree's trunks.

In one embodiment, the male shell has a conical protrusion 7 on the front end of the male shell, the female shell has a conical recess 8 on the front end of the female shell, and the conical protrusion 7 is corresponding to the conical recess 8. When the male connector 1 and the female connector 2 are connected, the conical protrusion 7 is inserted into the conical recess 8. Because the male connector 1 is connected in an inner wall of a tree's trunk and the female connector 2 is connected in an inner wall of another tree's trunk, the conical protrusion 7 is inserted into the conical recess 8 when the male connector 1 and the female connector 2 are connected.

Figure 6:
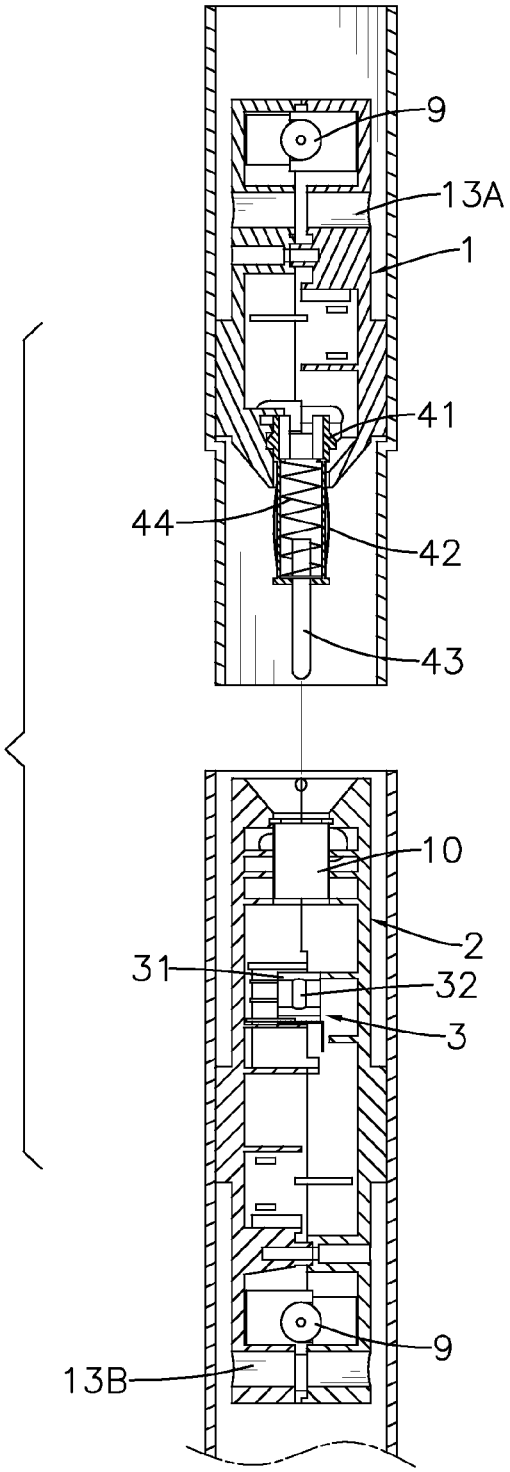
FIG. 6 is a cross-sectional side view of the quick mount connector assembly, shown installed in the tree trunk with the spring.

With reference to FIG. 6, another embodiment of the electrical connection shaft has a spring 44 between the shaft core 41 and the male contact shaft 43. When the front end of the male contact shaft 43 is inserted into the clamping base 3, the spring 44 can push the front end of the male contact shaft 43 to contact with the two pressing resilient pieces 31 such that the male contact shaft 43 and the clamping base 3 are contacted better.

Figure 7:
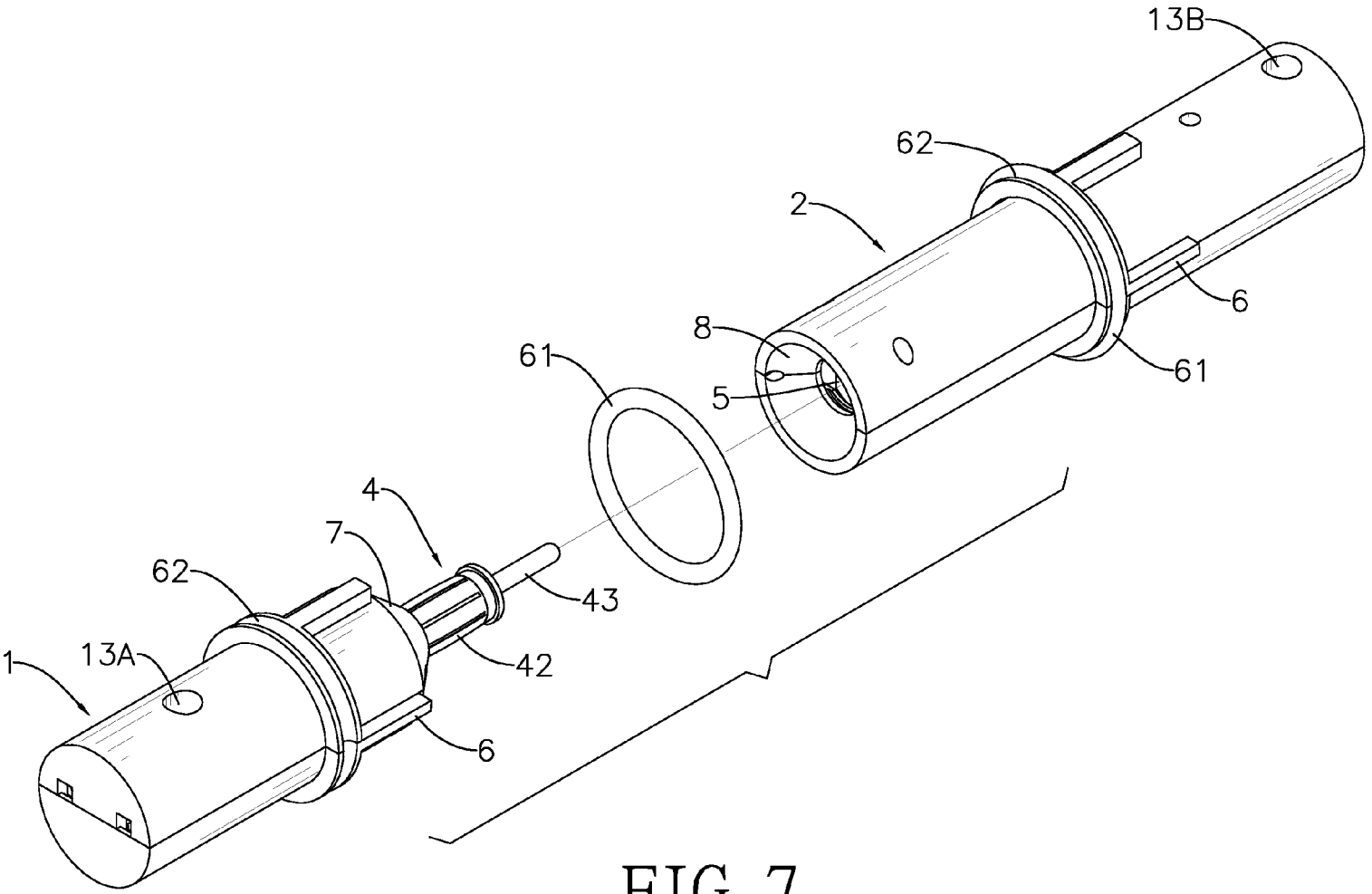
FIG. 7 is a schematic perspective view of the quick mount connector assembly with the ring groove, shown covered by the rubber ring.

With reference to FIG. 7, another embodiment of the quick mount connector assembly further has a rubber ring 61. The male connector 1 and the female connector 2 each respectively has a ring groove 62 around the male shell and the female shell, and the ring groove 62 is covered by the rubber ring 61. This advantage makes the connector assembly of the present invention applicable for Christmas trees of any size. When the ring groove 62 are covered by the rubber ring 61, the surface of rubber ring 61 can contact the inner wall of the tree's trunk to increase friction between the shells and the inner wall of the tree's trunk. As such, the male connector 1 and the female connector 2 are also securely fixed in the tree's trunks.

The male connector 1 and the female connector 2 of this invention are both installed in the Christmas tree's trunk, and the colorful strings of lights are intertwined around the Christmas tree's branches. So a power plug is needed to build an electrical connection. In this embodiment, the male shell and the female shell each respectively has at least one power base 9 in the shell. Only when the male connector 1 and the female connector 2 are connected together can currents run through the power base 9. It is convenient to connect the colorful lights and the power plug.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A quick mount connector assembly of an artificial Christmas tree, the quick mount connector assembly comprising:

a male connector comprising:

a male shell comprising:

a plug end, an electrical connection shaft being cylindrical and extending outward from the plug end, a through hole defined radially through the male shell, and a clamping pin installed in the through hole;

a female connector detachably connected to the male connector and comprising:

a female shell detachably connected to the male shell and comprising:

an electrical connection hole receiving the electrical connection shaft for building an electrical connection, a through hole defined radially through the female shell, and a clamping pin installed in the through hole of the female shell, wherein the male shell comprises a conical protrusion on a front end of the male shell, and the female shell comprises a conical recess on a front end of the female shell; the conical protrusion is corresponding to the conical recess; when the male connector and the female connector are connected with each other, the conical protrusion is inserted into the conical recess.

2. The quick mount connector assembly as claimed in claim 1, wherein the electrical connection shaft comprises:

a hollow shaft core, a male contact core, and a male contact shaft corresponding to the electrical connection hole; and the female shell comprises:

a clamping base for clamping the male contact shaft, and a female contact ring;

wherein the male contact core is mounted on an external surface of the shaft core securely, and the male contact shaft is inserted into a front end of the shaft core; when the electrical connection shaft and the electrical connection hole are connected with each other, a front end of the male contact shaft is inserted into the clamping base, and the female contact ring is selectively mounted on an external surface of the male contact core.

3. The quick mount connector assembly as claimed in claim 2, wherein the male contact core comprises multiple projecting ribs on an outer circumference of the male contact core and the female contact ring is a cylindrical ring; when the male contact core connects to the female contact ring, the projecting ribs are pressed against an inner wall of the cylindrical ring.

4. The quick mount connector assembly as claimed in claim 2, wherein the clamping base comprises two pressing resilient pieces, the two pressing resilient piece are installed on two opposite sides of the clamping base; and each of the pressing resilient pieces further comprises a semi-circular notch.

5. The quick mount connector assembly as claimed in claim 1, wherein the male shell includes a male upper shell and a male lower shell; the male upper shell and the male lower shell are engaged with each other and fastened by screws; the female shell also includes a female upper shell and a female lower shell, and the female upper shell and the female lower shell are also engaged with each other and fastened by screws.

6. The quick mount connector assembly as claimed in claim 5, wherein the male upper shell, the male lower shell, the female upper shell, and the female lower shell each respectively comprises two positioning protrusions and two square grooves; the square grooves are used to install the two positioning protrusions, bottoms of the positioning protrusions are inserted into the square grooves, and tops of the positioning protrusions are arc-shaped.

7. The quick mount connector assembly as claimed in claim 1, wherein the male shell and the female shell each respectively comprises at least one power base in the shell.

8. The quick mount connector assembly as claimed in claim 2, wherein the electrical connection shaft comprises a spring between the shaft core and the male contact shaft.

9. The quick mount connector assembly as claimed in claim 3, wherein the electrical connection shaft comprises a spring between the shaft core and the male contact shaft.

10. The quick mount connector assembly as claimed in claim 4, wherein the electrical connection shaft comprises a spring between the shaft core and the male contact shaft.

11. The quick mount connector assembly as claimed in claim 1, wherein the connector assembly further comprises a rubber ring; the male connector and the female connector each respectively comprises a ring groove around the male shell and the female shell, and the ring groove is covered by the rubber ring.

12. The quick mount connector assembly as claimed in claim 2, wherein the connector assembly further comprises a rubber ring; the male connector and the female connector each respectively comprises a ring groove around the male shell and the female shell, and the ring groove is covered by the rubber ring.

13. The quick mount connector assembly as claimed in claim 3, wherein the connector assembly further comprises a rubber ring; the male connector and the female connector each respectively comprises a ring groove around the male shell and the female shell, and the ring groove is covered by the rubber ring.

14. The quick mount connector assembly as claimed in claim 4, wherein the connector assembly further comprises a rubber ring; the male connector and the female connector each respectively comprises a ring groove around the male shell and the female shell, and the ring groove is covered by the rubber ring.

15. The quick mount connector assembly as claimed in claim 5, wherein the connector assembly further comprises a rubber ring; the male connector and the female connector each respectively comprises a ring groove around the male shell and the female shell, and the ring groove is covered by the rubber ring.

16. The quick mount connector assembly as claimed in claim 6, wherein the connector assembly further comprises a rubber ring; the male connector and the female connector each respectively comprises a ring groove around the male shell and the female shell, and the ring groove is covered by the rubber ring.

17. The quick mount connector assembly as claimed in claim 7, wherein the connector assembly further comprises a rubber ring; the male connector and the female connector each respectively comprises a ring groove around the male shell and the female shell, and the ring groove is covered by the rubber ring.

18. The quick mount connector assembly as claimed in claim 8, wherein the connector assembly further comprises a rubber ring; the male connector and the female connector each respectively comprises a ring groove around the male shell and the female shell, and the ring groove is covered by the rubber ring.

* * * * *